United States Patent [19]

Properzi

[11] Patent Number: 4,569,217

[45] Date of Patent: Feb. 11, 1986

[54] APPARATUS FOR CONVERTING ROD STOCK OR WIRE ROD INTO WIRE

[76] Inventor: Giulio Properzi, Via Pietro Cossa, 1 - Milano, Italy

[21] Appl. No.: 24,271

[22] Filed: Mar. 26, 1979

[30] Foreign Application Priority Data

Mar. 30, 1978 [IT] Italy ..... 21814 A/78

[51] Int. Cl.[4] ..... B21B 45/04; B21B 45/02

[52] U.S. Cl. ..... 72/206; 72/224; 72/247; 72/248; 72/226

[58] Field of Search ..... 72/206, 224, 247, 248, 72/274, 286, 226, 378, 201, 365, 366, 278, 284; 148/12 B

[56] References Cited

U.S. PATENT DOCUMENTS

| | | | |
|---|---|---|---|
| 328,591 | 10/1885 | Lenox | 72/224 |
| 1,899,659 | 2/1933 | Asbeck | 72/224 |
| 1,982,352 | 11/1934 | Richardson | 72/378 |
| 2,333,238 | 11/1943 | Finnie | 72/206 |
| 3,143,786 | 8/1964 | Jones et al. | 72/206 |
| 3,600,924 | 8/1971 | Martin | 72/234 |
| 3,810,371 | 5/1974 | Properzi | 72/201 X |
| 3,987,657 | 10/1976 | Properzi | 72/247 |
| 4,224,818 | 9/1980 | Jones et al. | 72/289 |

FOREIGN PATENT DOCUMENTS

| | | | |
|---|---|---|---|
| 476029 | 8/1951 | Canada | 72/206 |

*Primary Examiner*—Lowell A. Larson

*Attorney, Agent, or Firm*—Guido Modiano; Albert Josif

[57] ABSTRACT

An apparatus for converting rod stock or wire rod into wire comprises heating of the rod stock or wire rod, high speed rolling and cooling thereof, and final slight drawing to make the surface thereof smooth and finished. The high speed rolling is carried out by a rolling mill having a lightweight construction and roll stands comprising three rolls at 120° from one another. Two of the rolls are rotatably supported by shafts which have eccentrical ends. Two spindles having eccentrical ends engage with their ends corresponding seats in the ends of the shafts, so that rotation of the spindles provides rotation of the shafts and axial displacement thereof in order to adjust the rolling pass.

4 Claims, 6 Drawing Figures

APPARATUS FOR CONVERTING ROD STOCK OR WIRE ROD INTO WIRE

BACKGROUND OF THE INVENTION

This invention relates to a metallurgical apparatus for converting rod stock or wire rod into wire.

It is known that wire is generally obtained from rod stock or wire rod either manufactured by hot rolling heated billets, or by continuous casting and subsequent rolling, or on the extrusion press. In the following the term "rod stock" will also include wire rod and like material.

Rod stock is generally supplied in diameters from 5 to 10 mm, depending on the type of metal and its end use, and is then converted into wire by means of a drawing process.

The first step of the drawing process is called roughing, and consists of causing the rod stock to pass through a bore in a die (drawplate) having a smaller diameter than the rod stock diameter by applying an external pull or tractive force to the rod stock, and repeating said operation continuously in succession for a sufficient number of times to achieve a final diameter which lies generally in the 1.5–3 mm range. Drawing, therefore, implies stretching the metal, as allowed by the ductile properties of metals and their alloys, said stretching taking place in cold conditions.

Modern drawing machines have reached a high degree of sophistication, but yet unsolved are some of the problems which are typical of the method itself. The critical factor of drawing is in fact the high frictional resistance generated between the die and metal, which notwithstanding the use of highly sophisticated lubrication systems still leads to premature wear of the die and considerable heating of the metal, with attendant limitations to the drawing rate, and therefore the machine output.

Another problem resides in that the wire is required to withstand the entire deformation effort in the tensile form, which brings in substantially two added limitations. Firstly, the tension must be such as not to cause the wire to break, and this limits the maximum contraction that can be achieved with a pass through a given die or drawplate, thereby the number of the successive dies must be increased along with the overall size of the draw system, and secondly, the slightest fault in the wire, such as inclusions, microcracks, etc., in enhanced by the tension state of the wire and leads to the wire breaking, whereby the manual operation of inserting the wire through all of the dies downstream of the break point is to be repeated. That operation requires that the wire end be tapered to a smaller diameter than the die, the wire passed through the die, the draw bench actuated to supply a short section of wire, the wire end re-tapered, and so forth, prior to resuming continuous drawing process.

It should be further noted that during the drawing process, the material undergoes progressive work hardening, directly related, depending on the type of metal, to the sectional reduction undergone. Work hardening creates in the metal an increase of unit breaking load and reduction of the elongation percentage thereof. In excess of a certain amount of work hardening, the elongation percentage is so low as to make it impossible to draw the metal without prior annealing, which may be carried out continuously, but still involves substantial added costs.

SUMMARY OF THE INVENTION

This invention sets out to overcome the cited limitations and disadvantages encountered with traditional methods of converting rod stock into wire, by providing a method and related apparatus, whereby the conversion can be effected for a minimal cost and at a higher output rate.

A further object of the invention is to provide a method and apparatus as specified above, whereby the conversion from rod stock to wire is carried out in a fully automatic way, without any manual operation and risk of breaking the wire during the conversion thereof.

These objects are achieved by a method of converting rod stock or wire rod into wire, wherein the rod stock or wire rod is subjected continuously to a heating step, thereafter it is subjected to high speed rolling and then cooled and subjected to a slight drawing step such as to smooth and finish its surface.

With this type of method any chance of the wire breaking is virtually eliminated, since such break cannot occur during the rolling step, where the material is mainly compressed, nor can it occur during the final drawing step, because that operation only involves a slight correction of the section and surface, rather than drawing proper. The inventive method affords a considerably higher output than conventional drawing processes, there being practically no limitations to the production rate depending on overheating of the wire. Furthermore, the method according to this invention affords the advantage of a remarkable decrease in the power requirements for the converstion work, by virtue of the completely different principle (rolling instead of drawing) and of the fact that the metal can be worked at higher temperatures. Another advantage of the method of this invention is that it is much more flexible as far as the working temperatures are concerned, which temperature levels greatly affect the metallurgical properties of the wire to be obtained. The advantage should be pointed out, moreover, that the pressure action exerted by rolling on the wire has a beneficial effect on some faults of the wire, which in the traditional technique are instead enhanced by the drawing operation. Further advantages will become more apparent in the course of the description which follows hereinafter.

For implementing the method according to this invention, an appartus is proposed comprising, in succession, a heating box having guiding means and heating means for said rod stock or wire rod, at least one rolling stand having high speed operated rolls of lightweight construction, a simple drawing bench configurated for a very small sectional reduction of the wire and for smoothing and finishing the surface thereof, and wire pickup means at the output end of said drawing bench.

With such an apparatus, wherein a major part of the rod stock conversion work is carried out by means of a rolling mill, the advantage is attained of a longer life for the working parts, because the rolls of the rolling mill have a working surface which is far larger than the die working surface. A further advantage is that the rolling mill works equally well in the hot and cold conditions, contrary to what is the case with a draw bench, wherein the rod stock is introduced at ambient temperature and must then be controlled such as to ensure minimal heating of the dies and consequently a maximal production output. Thus all of the mechanical power converted into heat in the drawbench must be removed, which reduces the wire, at the last drawing pass, to a work hardened state, i.e. having high breaking load and low elongation. Since the market demand is instead mainly directed toward a low breaking load and high elongation type of wire, it is customary to make provisions for annealing in furnaces, by means of a separate and consequently costly operation, or continuous annealing in furnaces comprising a controlled atmosphere insulated environment wherein the wire, which travels at 30 to 40 m/sec over several pulleys, is subjected to an electric current of such power that its temperature raises above its re-crystallization temperature. The required electric power is very high because the wire only resides in the furnace for a very short time, even though the pulley system extends its path considerably, thereby this method is both expensive and of limited capabilities.

By contrast, in this invention, owing to the rolling mill being enabled to work equally well in cold and hot conditions, it becomes possible to arrange upstream of the rolling mill a heating or preheating station of low cost and high efficiency, since the rod stock travels at speeds of a few meters per second, which allows the metal to be rolled at a temperature—also conditioned by the coolant circulated through the mill itself—which is ideal for the attainment of the desired characteristics of the wire.

It has been found that greatest economical advantages can be secured by employing a mill of a light-weight type and simple to operate even at high speeds, as well as so constructed as to permit easy servicing and adjustment procedures.

BRIEF DESCRIPTION OF THE DRAWINGS

The principal features of such a mill, as well as other features and advantages of the invention, will be more clearly understood from the following detailed description of a preferred embodiment thereof, given herein merely for exemplary reasons and illustrated in the accompanying drawings, where.

DESCRIPTION OF THE PREFERRED EMBODIMENTS

Figure 1:
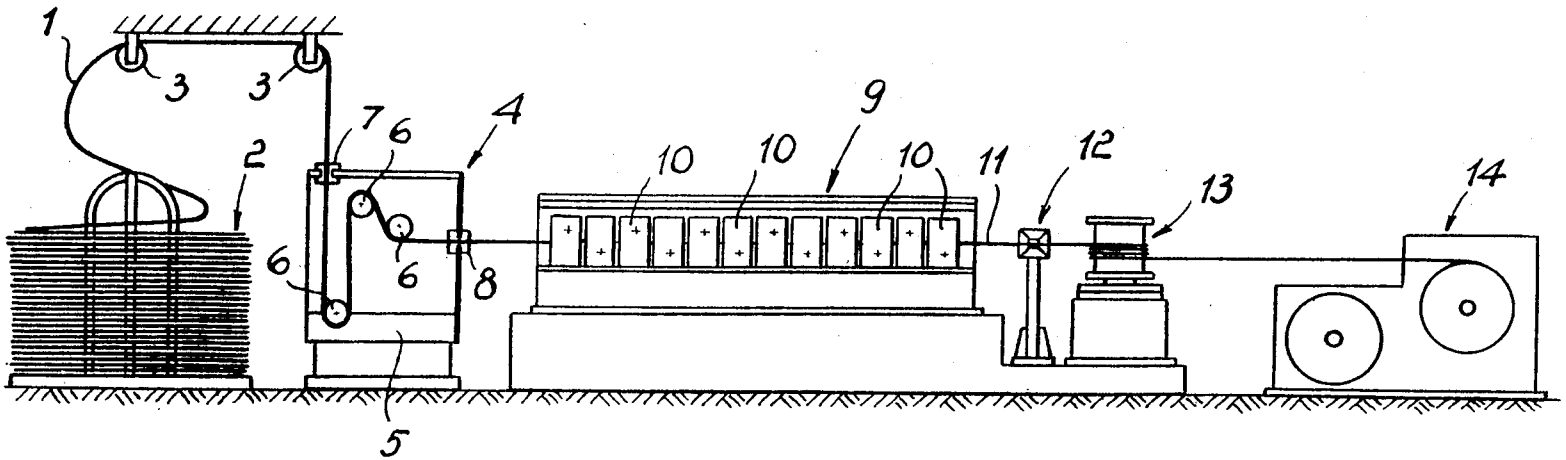
FIG. 1 shows schematically an apparatus according to this invention.
Figure 2:
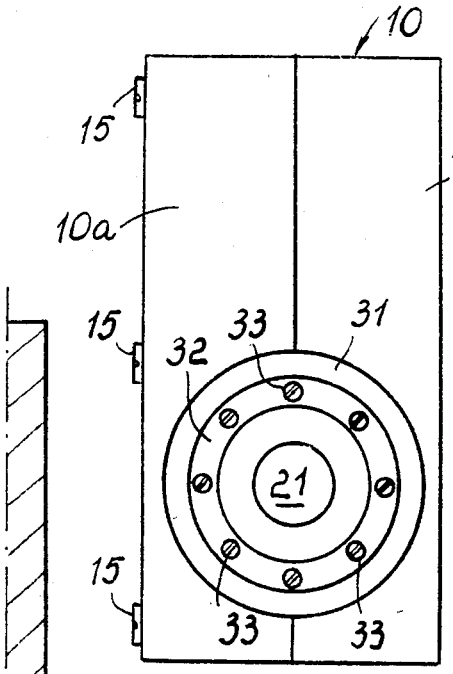
FIG. 2 is a side view of a rolling stand, specially sutiable for use in an apparatus according to this invention.
Figure 4:
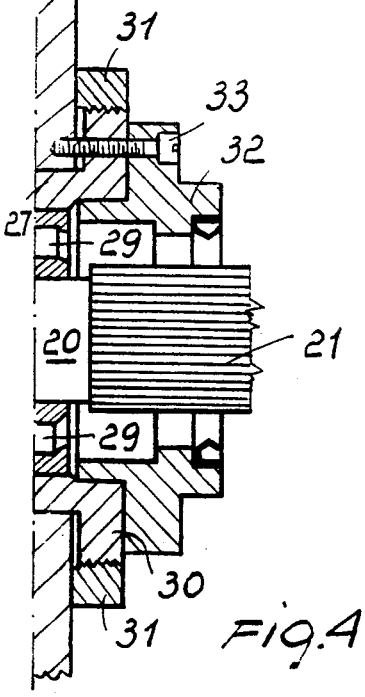
FIG. 4 is a detail view of the stand of FIG. 3 which does not appear in FIG. 3.

As shown in FIG. 1, the method according to this invention is preferably implemented starting from a rod stock 1 arranged in coils or bobbins 2, wherefrom the rod stock is unwound or paid out, e.g. by means of leader pulleys 3, at least in part driven rotatively by drive means, not shown. Thus, the rod stock 1 is moved to a heating box 4, wherein it is heated by heating means 5, of conventional design, e.g. steam operated, gas burners, induction tunnels, and is guided over guide means, e.g. in the form of pulleys 6. The heating box 4 has an inlet opening 7 and outlet opening 8, which are so constructed as to permit the rod stock to enter and exit in sealed relationship.

Downstream of the heating box 4, there is arranged a rolling mill 9 comprising a plurality of rolling stands 10, the structure whereof will be explained hereinafter. In the rolling mill 9, the rod stock 1 is converted to wire 11 having a diameter less than 5 mm, e.g. having a diameter of 1.5 mm.

Downstream of the rolling mill 9, is located a draw bench 12 arranged to only perform a slight drawing of the wire 11 emerging from the mill 9, for the purpose of making its sectional configuration uniform and its surface smooth. A pull drum 13 applies a tractive effort to the wire 11, downstream of the draw bench 12. The wire emerging from the draw bench has a diameter, for example, of 1.45 mm, and is then wound onto a take up device 14, known per se.

The apparatus described hereinabove is also equipped with protection means for avoiding oxidation of the rod stock (when such oxidation is a factor, like in the case of copper), at least between the heating box 4 and the outlet of the rolling mill 9, and with lubricating means, where such are required, said protective devices and said means being not shown in the drawings. Between the rolling mill 9 and draw bench 12, there may be further arranged a cooling box, in the event that the wire cannot be sufficiently cooled prior to reaching the draw bench or die 12.

According to a specially advantageous embodiment of the invention, the rolling mill 9 comprises rolling stands 10 (FIGS. 2–6), each consisting of shell halves 10*a* and 10*b* which are united in a plane perpendicular to the rolling axis and containing the axes of the mill rolls. The two shell halves are held together, e.g. by means of screws 15 engaging threaded holes 16.

By inspection of the open stand 10 (FIG. 3), it can be observed that the stand includes three mill rolls arranged at 120° to one another, namely a main roll 17 and two secondary rolls 18. The main or primary roll 17 is carried by a hub 19 rigid with the main shaft 20, which derives its motion from the rolling mill motive means, not shown, through a splined connection 21, in a manner known per se. The hub 19 has a bevel gear 22 for driving one of the secondary rolls 18. The roll 17 is held in position on the hub 19 by a ring 23 provided with a bevel gear 24 for driving the other secondary roll 18 and clamped against the roll 17 by screws 25 engaging the hub 19. The shaft 20 is carried in the rolling stand 10 within sleeves 26 and 27 with the interposition of bearings 28, 29 in a manner known per se. The sleeve 27 is provided on the outside thereof, at the splined connection 21, with a flange 30 having its peripheral surface threaded and in engagement with a ring nut 31, the rotation whereof affords adjusting capabilities for the main shaft 20 and main roll 17 in the axial direction. The operative position is made stable by a flanged sleeve 32, which locks the ring nut 31 against the stand 10 through screws 33 threaded into the stand itself.

The supporting structure for the main or primary roll 17 described herein has the advantage of facilitating replacement of the roll, since it will suffice, after opening the stand 10 and loosening the screws 33, that the assembly comprising the sleeves 26,27, bearings 28,29, and bevel gears 22,24 be removed, and then, after taking out the screws 25, to slide out the used roll 17, to install the new roll, and reassemble the assembly without disturbing the bearings, and accordingly without altering the calibration of the primary roll. Centering of the primary roll (in the axial direction) is also accomplished in a simple manner, after loosening the screws 33, by simply rotating the ring nut 31, and then tightening the screws 33 again.

The secondary rolls 18 are carried each by a bell housing 34, fabricated integral with a bevel gear 35 engaging the corresponding bevel gear 22 or 24 on the main roll 17, and are secured to their respective bell housings 34 by means of a clamping ring 36 held against the respective roll by screws 37 engaging the respective bell housing 34.

Each bell housing 34 is free to rotate on a stationary shaft 38 with the interposition of bearings 39 and is retained in its axial position by end rings 40,41, one whereof is threaded onto the shaft 38 and the other abuts against a collar 42 on the shaft itself. Each shaft 38 is carried at its ends 43,44 in respective seats 45,46, one half of each seat being formed in one of the two parts 10*a*, 10*b* making up the roll stand 10.

This construction also affords the advantage of easy replacement of the worn rolls, inasmuch as it will be sufficient, after opening the stand, to withdraw the shaft 38 along with the bearings 39, bell housing 34, ring 36, and respective roll 18, and then take out the screws 37 and slide the worn roll out, without disturbing the bearings in any way.

Figure 5:
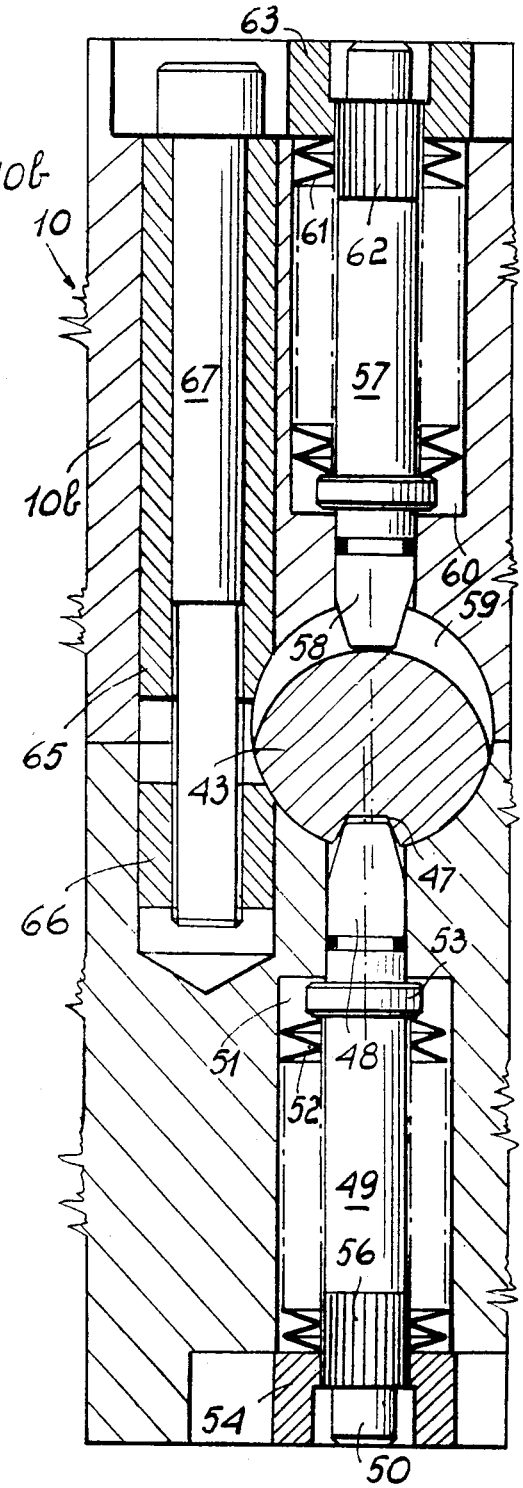
FIG. 5 shows, on an enlarged scale with respect to the preceding figures, means for adjusting the secondary mill rolls, shown in section as taken along a plane perpendicular to the roll axes.
Figure 6:
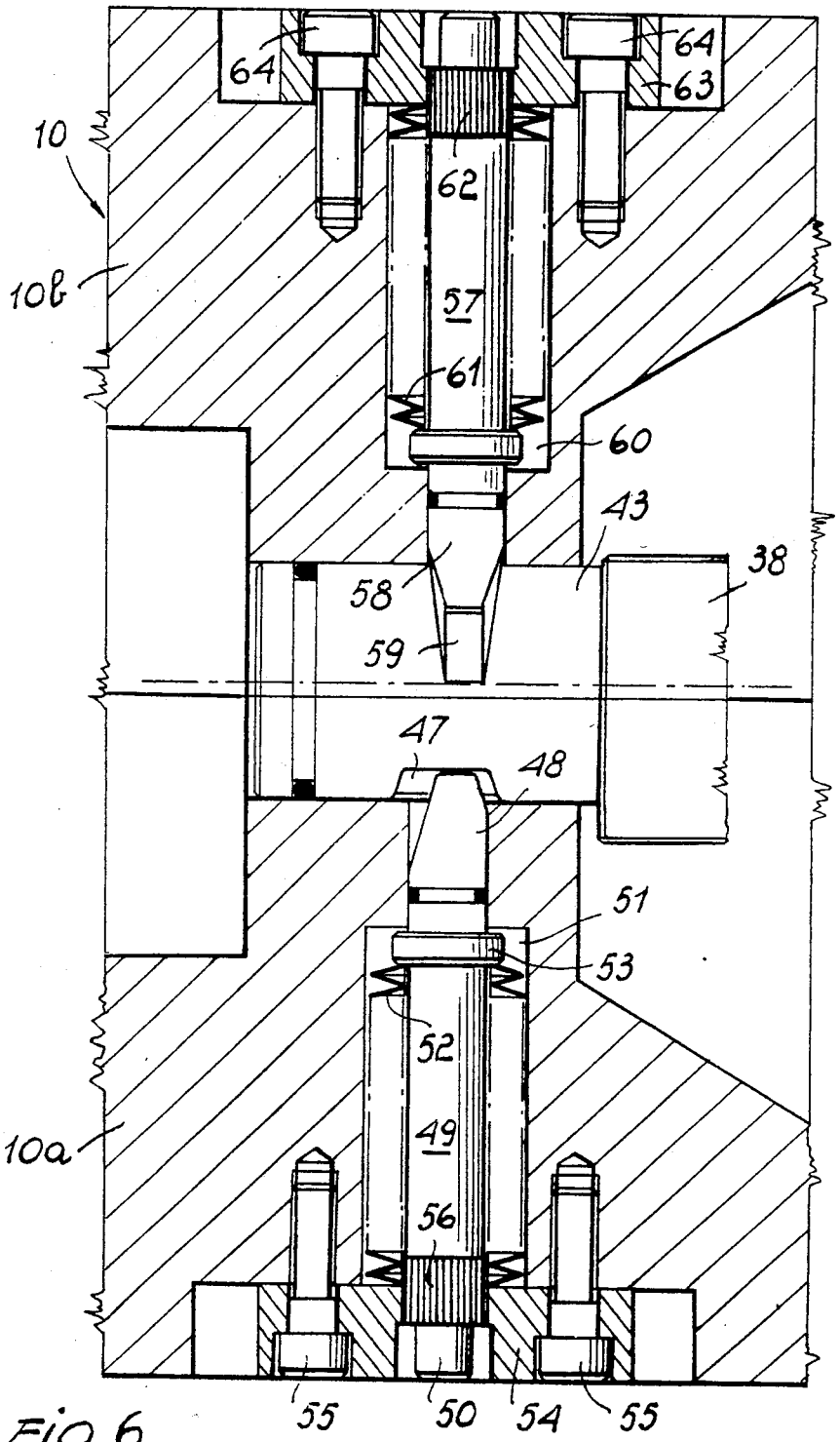
FIG. 6 is a view, on an enlarged scale with respect to the preceding figures, of the secondary roll adjusting means taken in section along a plane containing the roll axes.

For adjusting the secondary rolls 18, the invention provides for a device, as shown in FIGS. 5 and 6, which permits the secondary rolls to be adjusted from the outside of the rolling stand, which brings about a considerable economical advantage as resulting from the shorter time required for this operation.

Figure 3:
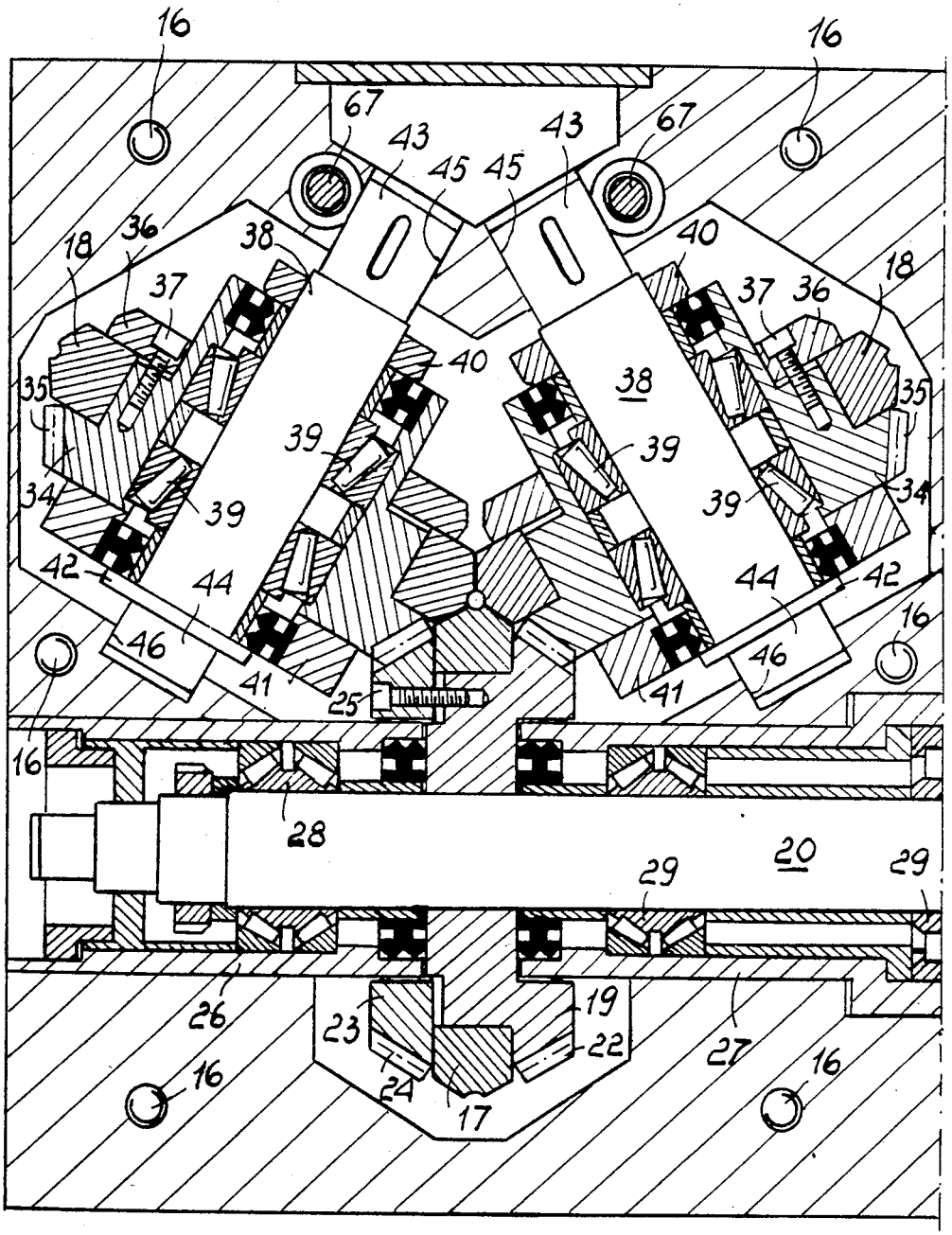
FIG. 3 is a centerplane sectional view, on an enlarged scale, taken through the rolling stand of FIG. 2 along the plane containing the axes of the mill rolls.

As shown in FIGS. 3, 5 and 6, the ends 43, 44 of the secondary rolls 18 are eccentrically located with respect to the axis of the respective shaft 38 and consequently to the axis of the secondary roll. At least one of said ends has a machined seat 47, the axial dimension whereof is larger than the circumferential dimension. The seat 47 is penetrated by one end 48 of an adjustment spindle 49, the end portion wherein is eccentrical with respect to the axis of the spindle itself and has cross dimensions such as to fit in the seat 47 virtually without play in the circumferential direction of the seat. The opposite end 50 of the spindle 49 can be reached from outside the rolling stand 10.

The spindle 49 is received in a seat 51 in the stand 10, which also accommodates cup springs 52 between a collar 53 on the spindle 49 and a plate 54 attached to the stand outside by means of screws 55. The spindle 49 penetrates the plate 54 with a splined portion 56 which engages a correspondingly splined portion of the plate itself.

For adjusting the secondary rolls 18 in a direction perpendicular to the roll axes, i.e. for adjusting the gauge or calibrated dimension of the rolling pass, it will be sufficient to loosen the screws 55, thereby the plate 54, under the action of the springs 52, moves away from the structure of the rolling stand as far as required for disengagement from the splined portion 56. Thus, it becomes possible to rotate the spindle 49 from the outside with an appropriate tool, thereby the offset end 48 of the spindle produces a rotation of the offset end 43 of the shaft 38 about the axis of the end 43 itself, and accordingly a displacement of the shaft 38 perpendicularly to its own axis towards the stand center or in the opposite direction, depending on the direction of the rotation imparted to the spindle 49.

Advantageously, the axial dimension of the splined portion 56 is such that it is possible to disengage the offset or eccentrical end 48 from the seat 47, after loosening the screws 55, without disengaging the splined portion 56 from the plate 54. In this manner, it becomes possible to disassemble the shaft 38 without losing the original gauge setting, which is automatically restored upon reassembling the shaft and the plate 54.

For centering the secondary rolls 18 in a direction parallel to their own axes, a device is provided which is substantially similar to the one just described, and including a spindle 57 located on the opposite side to the spindle 49 and having an eccentrical or offset end 58 which penetrates a seat 59 in the end 43. The seat 59 encircles the end 43 substantially over a half circle on the opposite side to the seat 47. The offset terminating portion of the spindle 57 has a cross dimension equal to the axial dimension of the seat 59. The spindle 57 is accommodated in a seat 60 in the rolling stand, is subjected to the action of cup springs 61, has a splined portion 62 formed thereon, and is retained by a plate 63 attached to the stand by means of screws 64 like in the adjustment device of the pass gauge.

Adjustment of the centering is effected similarly to the adjustment of the pass gauge, with the difference that the arrangement of the offset end 58 and seat 59 produces an axial displacement of the shaft 38 for each rotation of the spindle 57. Also in this case, it is possible to remove the shaft 38 without losing the centering adjustment, the procedure being the same as described hereinabove for the adjustment of the pass gauge.

In order for the spindles 49 and 57 to be relieved of the loads induced in the shafts 38 by the rolling efforts, the ends of the shafts 38 are locked by two clamping elements 65, 66 having a partly cylindrical contour profile, one of said elements being made rigid with the rolling stand and the other clamped thereagainst by means of a screw 67.

It will be appreciated from the foregoing that the instant rolling mill has a particularly economical and light structure, it being easy to service and adapt for individual rolling requirements. These benefits make it specially suitable for the implementation of the method according to the invention, which requires high speed operation capabilities and involves, therefore, greater wear of the working components than in conventional rolling processes; it will be appreciated, however, that the application of the described rolling mill is not limited to this method, since it lends itself equally well and quite advantageously to the rolling of ingots and bar stocks to be converted to wire rods.

It will be understood from the above that the apparatus of this invention is also simple, what is required being just an initial starting step, whereafter the apparatus is able to operate in a fully automatic mode. In fact, the initial step, which can be completed in a very quick manner, involves insertion of the rod stock end through the heating box 4 and then through the rolling mill 9, which is initially operated stepwise, thereafter the wire 11 emerging from the rolling mill is passed through the die 12 and led to the take up device 14, where it is wound automatically. Upon completion of these preliminary operations, the plant becomes capable of continuous operation, to attain working speeds in the order of up to 50–60 m/sec.

Also remarkable is the rolling mill compact size, which reduces considerably the dimensions of the plant for conversion of the rod stock over the traditional drawplate systems.

In addition thereto, the rod stock employed does not require to be annealed, but may be of any types.

The invention as described is susceptible to many modifications and variations, all of which fall within this inventive concept. Thus, for example, the rolling stands 10 could have only two rolls, a primary one and secondary one, carried and adjustable in the manner described for the rolls 17 and 18 above.

I claim:

1. An apparatus for converting rod stock or wire rod into wire, comprising in succession a heating box having guiding means and heating means for said rod stock or wire rod, at least one rolling stand having high speed operated rolls of light-weight construction for rolling the rod stock or wire rod into wire having a diameter less than 5 mm, a simple drawing bench configurated for a very small sectional reduction of the wire and for smoothing and finishing the surface of the wire coming out from said at least one rolling stand, and wire pickup means at the output end of said drawing bench, the apparatus, further comprising a plurality of rolling stands each having three rolls arranged at 120° from one another, comprising two shafts each rotatably supporting respective one of said rolls and each having eccentrical ends, at least one of said ends having a machined seat, and further comprising an adjustment spindle having one end eccentrically arranged with respect to the axis of said spindle and engaging said seat, whereby rotation of said spindle produces a rotation of said end of said shafts in the seats therefor and consequent displacement of the respective one of said rolls towards the rolling center or in the opposite direction.

2. An apparatus according to claim 1, further comprising clamping elements for holding in position said two shafts, said clamping elements being adapted for actuation from outside said rolling stand.

3. An apparatus for converting rod stock or wire rod into wire, comprising in succession a heating box having guiding means and heating means for said rod stock or wire rod, at least one rolling stand having high speed operated rolls of light-weight construction for rolling the rod stock or wire rod into wire having a diameter less than 5 mm, a simple drawing bench configurated for a very small sectional reduction of the wire and for smoothing and finishing the surface of the wire coming out from said at least one rolling stand, and wire pickup means at the output end of said drawing bench, the apparatus, further comprising a plurality of rolling stands each having three rolls arranged at 120° from one another, comprising two shafts each rotatably supporting a respective one of said rolls and each having at least one end having a seat extending substantially over a half circle, and further comprising an adjustment spindle having one end eccentrically arranged with respect to the axis of said spindle and engaging said seat, whereby rotation of said spindle produces an axial displacement of said end of said shafts for the purpose of centering the respective one of said rolls.

4. An apparatus for converting rod stock or wire rod into wire, comprising in succession a heating box having guiding means and heating means for said rod stock or wire rod, at least one rolling stand having high speed operated rolls of light-weight construction for rolling the rod stock or wire rod into wire having a diameter less than 5 mm, a simple drawing bench configurated for a very small sectional reduction of the wire and for smoothing and finishing the surface of the wire coming out from said at least one rolling stand, and wire pickup means at the output end of said drawing bench, wherein said at least one rolling stand has three rolls arranged at 120° from one another, comprising two shafts each rotatably supporting a respective one of said rolls and each having eccentrical ends, at least one of said ends having an elongate machined seat extending in the direction of the axis of said end and a circumferential seat extending substantially over a half circle on said end, and further comprising a first adjustment spindle having one end eccentrically arranged with respect to the axis of said first spindle and engaging said elongate seat such that rotation of said first spindle produces a rotation of said end of said shafts in the support seats therefor and consequent displacement of the respective of said rolls towards the rolling center or in the opposite direction, and a second adjustment spindle having one end eccentrically arranged with respect to the axis of said second spindle and engaging said circumferential seat such that rotation of said second spindle produces an axial displacement of said end of said shafts for the purpose of centering the respective one of said rolls, said first and second spindle each having a splined portion at the end thereof remote from said end in engagement with the respective one of said seats, and said rolling stands having two plates removably secured thereto and each having an opening provided with a splined portion matingly engaging a respective one of said splined portions of said first and second spindle, said plates retaining the angular position of said spindles even after the rolling mill rolls have been disassembled.

* * * * *